US009062483B1

(12) United States Patent
McGrath

(10) Patent No.: US 9,062,483 B1
(45) Date of Patent: Jun. 23, 2015

(54) FREE-WHEELING HINGE ASSEMBLY

(71) Applicant: Andrew H. McGrath, Concord, CA (US)

(72) Inventor: Andrew H. McGrath, Concord, CA (US)

( * ) Notice: Subject to any disclaimer, the term of this patent is extended or adjusted under 35 U.S.C. 154(b) by 0 days.

(21) Appl. No.: 14/307,900

(22) Filed: Jun. 18, 2014

(51) Int. Cl.
*E05D 5/10* (2006.01)
*E05D 7/00* (2006.01)

(52) U.S. Cl.
CPC ..... *E05D 7/00* (2013.01)

(58) Field of Classification Search
CPC ..... E05D 3/02; E05D 3/125; E05D 3/127
USPC ..... 16/104, 273, 386
See application file for complete search history.

(56) References Cited

U.S. PATENT DOCUMENTS

| | | | | | |
|---|---|---|---|---|---|
| 315,566 | A * | 4/1885 | Spring | 403/150 |
| 499,923 | A * | 6/1893 | Howarth | 16/386 |
| 508,983 | A * | 11/1893 | Rost | 16/392 |
| 2,000,856 | A * | 5/1935 | Lyons | 16/276 |
| 2,729,473 | A * | 1/1956 | Warshawsky | 285/153.1 |
| 3,591,669 | A * | 7/1971 | Memory | 264/101 |
| 3,879,799 | A * | 4/1975 | Williams | 16/89 |
| 4,037,978 | A * | 7/1977 | Connelly | 403/164 |
| 6,264,392 | B1 * | 7/2001 | Wise et al. | 403/112 |
| 2008/0104797 | A1 * | 5/2008 | Chung et al. | 16/224 |

* cited by examiner

*Primary Examiner* — Roberta Delisle
(74) *Attorney, Agent, or Firm* — Charles L. Thoeming

(57) ABSTRACT

A free-wheeling hinge assembly includes a base element, a cap element, and an internal pivot assembly allowing the cap element to pivot 360 degrees transversely to a hinge assembly central axis and in relation to the base element. Geometric ends of the hinge assembly allow insertion into any two component corresponding geometric recesses to be so pivoted and repositioned.

4 Claims, 1 Drawing Sheet

FREE-WHEELING HINGE ASSEMBLY

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

TECHNICAL FIELD

This invention relates to a free-wheeling hinge assembly that, for instance, is adaptable to ready-to-assemble components for connecting one or more substantially external support member(s) defined by the particular utility of the overall assembly to at least one fixed support structure, and for providing a free-wheeling hinge assembly to positionally adjust and secure a planar member 360 degrees about a central hinge axis orthogonally disposed to the support structure.

BACKGROUND OF THE INVENTION

Adjustable and lockable hinge assemblies for bracketing are well known in the art and typically comprise a limited degree of range of motion aligned with a central hinge axis, as exemplified by door hinge assemblies.

Designing and assembling these hinge elements is ordinarily complicated since dimensions, load factors, code requirements, and aesthetics converge to present free-wheeling hinges which are labor and component intensive. Often free-wheeling hinge assemblies will have many component parts and require several tools for assembly. Moreover, with current technology, uses of free-wheeling hinge assemblies require broader ranges of hinge adaptability than what is provided in the art, and even when a custom design is presented, installation of the free-wheeling hinge assembly is time consuming.

Various types of free-wheeling hinge assemblies are used for rotating planar surfaces with respect to a support component about a common axis. Many ready to assemble free-wheeling hinge assemblies utilize location dependent uprights or support members that multiply the effort needed to design and assemble free-wheeling hinge assemblies and that intensify the complexity of the process.

Presently, most free-wheeling hinge assemblies are installed by the seller because of the complexity of assembling. Thus, many free-wheeling hinge assemblies are handled fully or most fully assembled which presents bulky cargo that takes up considerable amount of space and is difficult to transport.

Additionally, when one part of a piece of a free-wheeling hinge assembly is damaged, often the entire product must be returned instead of the damaged part. For example, when free-wheeling hinge assemblies for adjacent planar surfaces fail or are defective, often the entire free-wheeling hinge assembly must be replaced.

Finally, the free-wheeling hinge assemblies need to be supported by adequate and aesthetically pleasing attachment components for securing one or more of the hinge assemblies to one or more free-wheeling hinge assemblies to support structures.

DISCLOSURE OF INVENTION

The present invention relates to adjustable free-wheeling hinge assemblies that can be employed readily over a wide array of applications to connect a variety of parallel oriented surface and support members, while still satisfying the complement of requirements presented by dimensions, load factors, codes, and design preferences. Furthermore, the free-wheeling hinge assemblies disclosed and claimed herein are fashioned in such a manner as to maximize the utility of the embodiments of hinge assemblies over a broad range of applications, while minimizing the labor, parts and tools required for implementation. Since the free-wheeling hinge assemblies are characterized by their universality and relative simplicity and ease of installation, they serve to fulfill both original and retrofit free-wheeling hinge requirements for multiple applications.

For example, without limitation, an embodiment of the free-wheeling hinge is adaptable to bracket assemblies having a plurality of hinge assemblies both locking and free-wheeling, when one or more of the hinge assemblies can be free-wheeling for mounting, positioning and securing longitudinally disposed bracket panel members to at least one fixed support structure, and allowing for 360 degree positional adjustment of the longitudinally disposed bracket panel members along the adjustable and lockable hinge central axis.

The free-wheeling hinge assembly provides a base element, a cap element, and an integral pivot point communicating with a common concentric channels within the base and cap connection about a central axis, allowing the cap element and any connected element thereto to pivot 360 degrees transversely to the central axis and in relation to the base element. Geometric ends of the cap and base elements of the free-wheeling hinge assembly allow insertion into any two components to be so pivoted and repositioned relative one to the other.

BRIEF DESCRIPTION OF DRAWINGS

Further features and advantages will become apparent from the following detailed description made with reference to the accompanying drawings, wherein.

MODES FOR CARRYING OUT THE INVENTION

This detailed description merely describes exemplary embodiments and is not intended to limit the scope of the claims in any way. Indeed, the invention as claimed is broader than and unlimited by, the exemplary embodiments, and the terms used in the claims have their full ordinary meaning. For example, while the specific embodiments described herein relate to various assemblies using the free-wheeling hinge for use alone, or in conjunction with a plurality of lockable hinges in securing bracketing components or bracketing assemblies integrally or to other external structures, and/or immobilizing and/or adjusting one component with respect to another component about a common axis, the exemplary features and embodiments of the present application may additionally or alternatively be applied to other types of assemblies having combined locking/free-wheeling hinge arrangements, including, for example, various types of portable screens, panel bracketing, extending ladders, extending support hinges, folding hinges, rotisserie assemblies, frame hinges, hinges that permanently attach, releasably attach, and/or remain detached from a bracketing assembly, or other assembly providing one or more paired components to be rotated and secured, one relative to the other, and other types of uses, for example, with other portable items, such as, without limitation, sneeze guard assemblies, screens, tables, beds, panel stands, lecterns, carrying racks, storage racks, furniture, grills, tools, and electronic devices.

Figure 1:
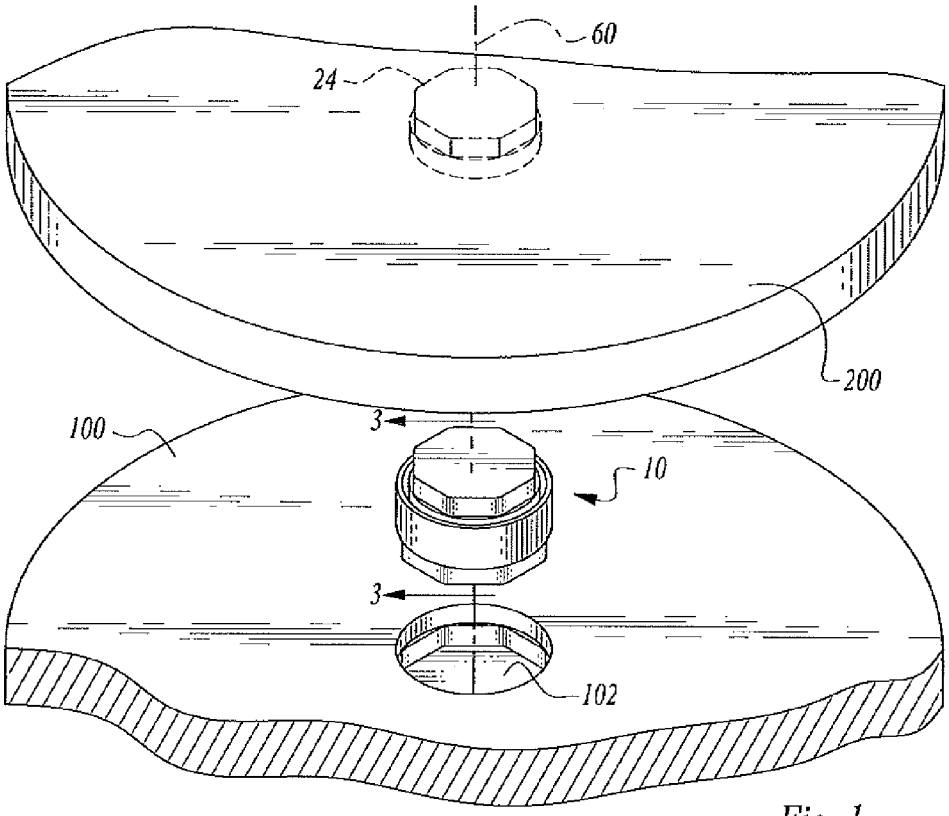
FIG. 1 is a perspective view of an embodiment of a free-wheeling hinge assembly 10 that is adapted to a support 100 and a planar surface 200 allowing the planar surface 200 to pivot 360 degrees transversely to the central axis 60 and in relation to the support 100.
Figure 2:
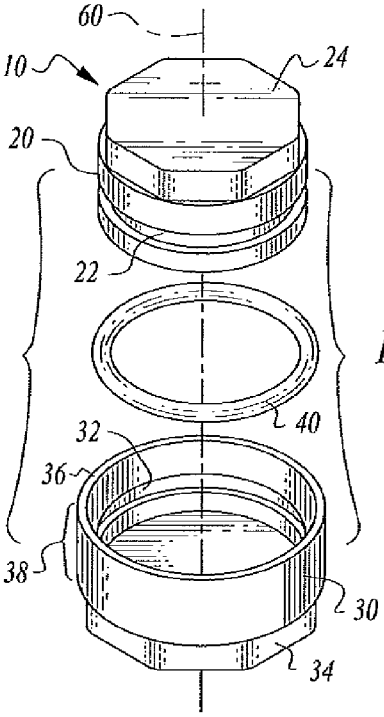
FIG. 2 is an exploded perspective view of the embodiment of the free-wheeling hinge assembly 10 of FIG. 1, depicting a base 30 being adaptively receiving and securing a cap 20 and an O-ring 40.
Figure 3:
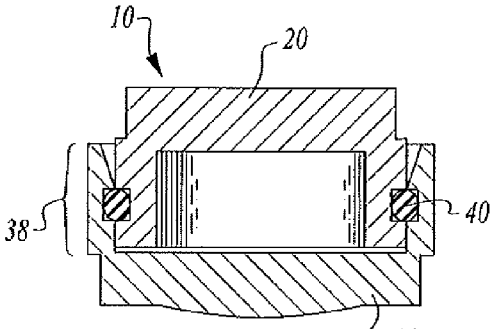
FIG. 3 is a cross-sectional view of the embodiment of the free-wheeling hinge assembly 10 of FIG. 1 taken at "3-3."

Referring now to FIG. 1-3, an embodiment of a free-wheeling hinge assembly is illustrated and designated by reference numerals 10.

An embodiment of a free-wheeling hinge assembly 10 includes a base element 30 having a solid cast geometric end 34 and a central longitudinal axis central longitudinal axis 60, FIGS. 1-2. A base element 30 cylindrical length 38 has an open end 36.

An annular groove 32 around the base element 30 cylindrical length inside surface defines a plane transverse to the central longitudinal axis 60, and the base element annular groove 32 is sized to receive and hold an O-ring 40, FIGS. 2-3.

An embodiment of a free-wheeling hinge assembly 10 further includes a cap element 20 having a solid cast geometric end 24 and a central longitudinal axis 60, FIGS. 1-3. The cap element 20 includes a cylindrical length sized to be received by and interference fitted to the base element 30 open end 36. An annular groove 22 around the cap element 20 cylindrical length external side defines a plane transverse to the cap element 20 central longitudinal axis 60, and is sized to receive and hold the O-ring 40 received within the cap element annular groove 22 around the cap element 20 cylindrical length external surface.

An embodiment of the free-wheeling hinge assembly 10 provides a 360 degree pivot feature between the cap element 20 and the base element 30, the pivot action being transverse to and about the central longitudinal axis 60 with the cap element 20 and the base element 30 pivoting around each other along O-ring 40, when force is applied to either the support 100 or the planar surface 200.

Embodiments of the free-wheeling hinge assembly 10 include use of an O-ring lubricant, such as DuPont® Krytox®, or Dow Corning® III O-Ring Valve Silicone Lubricant, or similar products to maintain the ease of motion for the pivot of the cap element 20 around the base element 30 along O-ring 40 within annular grooves, 22 and 32, respectively.

Embodiments of the free-wheeling hinge assembly 10 provide the cap element 20 solid cast geometric end 24 and the base element 30 solid cast geometric end 34 which include, without limitation, corresponding geometric shapes of ovals, oblongs, triangles, squares, rectangles, pentagons, hexagons, heptagons, octagons, and other multi-sided polygons capable of securely holding the free-wheeling hinge assembly 10 between corresponding external member components (i.e., support 100 or the planar surface 102, FIG. 1) while transferring directional forces applied to the external member components, support 100 or the planar surface 200, to and through the free-wheeling hinge assembly 10.

Embodiments of the free-wheeling hinge assembly 10 provide the cap element 20 solid cast geometric end 24 and the base element 30 solid cast geometric end 34 to be pressed fit or interference fit into corresponding geometrically configured external member component recesses (i.e., support 100 and the support geometrically configured recess 102, FIG. 1).

A preferred embodiment of a free-wheeling hinge assembly 10 includes an octagonal cap geometric end 24, an octagonal base geometric end 34, and octagonal external member component recesses (i.e., support 100 and the support recess 102, FIGS. 1-3).

The base element 30 and the cap element 20 of embodiments of the free-wheeling hinge assembly 10 are manufactured from brushed aluminum, high strength carbon-composites, steel, stainless steel, and any similar light weight, high strength metal alloys. The base element 30 and the cap element 20 of the preferred embodiment of the free-wheeling hinge assembly 10 are manufactured from brushed aluminum.

Embodiments of free-wheeling hinge assembly 10 could be used in combination with my push-button, locking hinge assembly as disclosed in my co-pending U.S. Non-provisional patent application Ser. No. 14/264,722 (the '722 application) filed Apr. 29, 2014. The 722 application is incorporated herein by reference as if fully set forth in this disclosure.

Therefore, the foregoing is considered as illustrative only of the principles of the free-wheeling hinge assemblies. Additionally, since numerous modifications and changes will readily occur to those skilled in the art, it is not desired to limit the free-wheeling hinge assemblies to the exact construction and operation shown and described, and further, all suitable modifications and equivalents may be resorted to, falling within the scope of the free-wheeling hinge assemblies.

I claim:

1. A free-wheeling hinge assembly comprising, in combination:

a) a base element comprising: a solid cast geometric end comprising geometric shapes selected from the group consisting of ovals, oblongs, triangles, squares, rectangles, pentagons, hexagons, heptagons, octagons, and other multi-sided polygons capable of securely holding the free-wheeling hinge assembly between corresponding external member component geometric recesses and transferring directional forces applied to the external member components to the free-wheeling hinge assembly; a cylindrical length comprising an external side and an internal side; a central longitudinal axis; an open end; and an annular groove around the cylindrical length internal side, the groove defining a plane transverse to the central longitudinal axis;

b) a cap element comprising: a solid cast geometric end comprising geometric shapes selected from the group consisting of ovals, oblongs, triangles, squares, rectangles, pentagons, hexagons, heptagons, octagons, and other multi-sided polygons capable of securely holding the free-wheeling hinge assembly between corresponding external member component geometric recesses and transferring directional forces applied to the external member components to the free-wheeling hinge assembly; a cylindrical length comprising an external side and an internal side; a central longitudinal axis; a cylindrical recess defined by the cylindrical length internal side; an open end sized to be received by and interference fitted into base open end; and an annular groove around the cap cylindrical length external side, the annular groove defining a plane transverse to the base central longitudinal axis; and c) an O-ring sized to be received within (i) the annular groove around the base cylindrical length internal side, and (ii) the annular groove around the cap cylindrical length external side, the O-ring serving to provide a pivot surface between the base element and the cap element;

wherein the free-wheeling hinge assembly provides a 360 degree pivot feature around the O-ring between the cap element and the base element, the pivot action being along a plane transverse to the central longitudinal axis and about the central longitudinal axis.

2. A free-wheeling hinge assembly comprising, in combination:

a) a housing comprising (i) two geometric ends, each housing geometric end sized to be press-fitted into and held by separate component geometric recesses to provide a pivot point between the separate components along a housing central longitudinal axis, each housing end comprising open cylindrical ends comprising internal and external surfaces, with a first housing open cylindrical end comprising an annular groove orthogonal to the housing central longitudinal axis on a first housing open cylindrical end external surface, the first housing open end sized to be received by and interference fitted into a second housing open cylindrical end comprising an annular groove orthogonal to the housing central longitudinal axis in the second housing internal surface, and each housing end further comprising materials selected from the group consisting of brushed aluminum, high strength carbon-composites, steel, stainless steel, and any similar light weight, high strength metal alloys; (ii) a second housing end cylindrical length between the conjoined housing ends, the second housing end cylindrical length comprising an external surface, whereby the external surface defines a space between the separate components once the housing has been press-fitted to and held by the separate component geometric recesses; and (iii) a housing channel defined by communicating annular grooves in the respective housing end internal and external surfaces; and b) an O-ring housed with the housing channel to rotate one housing end 360 degrees about the opposite housing end along a plane orthogonal to the housing central longitudinal axis;

whereby pressure applied to either separate component provides 360 degrees of rotation of the separate component attached to one housing end along a plane orthogonal to the housing central longitudinal axis about the separate component attached to the opposite housing end.

3. The free-wheeling hinge assembly of claim 2 further comprising an O-ring lubricant to maintain the ease of motion for the O-ring housed with the housing channel to rotate one housing end 360 degrees about the opposite housing end along a plane orthogonal to the housing central longitudinal axis.

4. The free-wheeling hinge assembly of claim 2, wherein the housing ends and separate component geometric recesses comprise corresponding geometric shapes selected from the group consisting of ovals, oblongs, triangles, squares, rectangles, pentagons, hexagons, heptagons, octagons, and other multi-sided polygons capable of securely holding the free-wheeling hinge assembly between corresponding external member components and transferring directional forces applied to the external member components to the free-wheeling hinge assembly.

* * * * *